US011751654B2

(12) United States Patent
Lansing et al.

(10) Patent No.: US 11,751,654 B2
(45) Date of Patent: Sep. 12, 2023

(54) CONTACT LENS PACKAGING

(71) Applicant: Bausch + Lomb Ireland Limited, Dublin (IE)

(72) Inventors: Baxter J. Lansing, Ontario, NY (US); Arvind M. Rao, Rochester, NY (US); James Dibella, Macedon, NY (US); Joseph W. Hoff, Fairport, NY (US)

(73) Assignee: Bausch + Lomb Ireland Limited, Dublin (IE)

( * ) Notice: Subject to any disclaimer, the term of this patent is extended or adjusted under 35 U.S.C. 154(b) by 0 days.

(21) Appl. No.: 17/462,962

(22) Filed: Aug. 31, 2021

(65) Prior Publication Data

US 2023/0060534 A1 Mar. 2, 2023

(51) Int. Cl.
*A45C 11/00* (2006.01)

(52) U.S. Cl.
CPC ..... *A45C 11/005* (2013.01)

(58) Field of Classification Search
CPC ..... A45C 11/005; A45C 11/046; B65D 2585/545
USPC ..... 206/5.1
See application file for complete search history.

(56) References Cited

U.S. PATENT DOCUMENTS 3,741,377 A * 6/1973 Krellen ..... A45C 11/005 220/834
3,990,579 A * 11/1976 Manning ..... A45C 11/005 206/5.1
5,474,169 A * 12/1995 Bauman ..... A45C 11/005 206/5.1
5,711,416 A * 1/1998 Bauman ..... B65D 75/52 206/210
5,960,956 A * 10/1999 Langanki ..... A61F 2/0095 206/440
6,138,312 A * 10/2000 Cummings ..... A61L 12/086 15/104.93
6,280,530 B1 * 8/2001 Pankow ..... C11D 3/386 15/104.93
7,086,526 B2 8/2006 Newman
D556,602 S 12/2007 Clements et al.
D556,603 S 12/2007 Barnes et al.
7,374,037 B2 5/2008 Lipscomb et al.
7,410,050 B2 8/2008 Py et al.
7,426,993 B2 9/2008 Coldrey et al.
7,461,740 B2 12/2008 Newman
7,699,162 B2 4/2010 Tokarski et al.
7,784,608 B2 8/2010 Tokarski et al.
7,938,255 B2 5/2011 Newman
8,281,920 B2 10/2012 Tokarski et al.
8,317,016 B2 11/2012 Tokarski et al.
D686,922 S 7/2013 Davis et al.
D686,923 S 7/2013 Aldridge et al.
(Continued)

*Primary Examiner* — Steven A. Reynolds
(74) *Attorney, Agent, or Firm* — Harness, Dickey & Pierce, P.L.C.

(57) ABSTRACT

A contact lens package includes a first layer, a support coupled to the first layer, a lens, and a second layer. The support includes a scaffold and a porous member attached to the scaffold where the porous member includes a curved surface. The lens includes an anterior surface and a posterior surface, and the posterior surface of the lens is disposed on the curved surface of the porous member. The second layer is coupled to the first layer to seal the support and the lens between the first layer and the second layer.

22 Claims, 10 Drawing Sheets

(56) References Cited

U.S. PATENT DOCUMENTS

| | | | | |
|---|---|---|---|---|
| 9,173,463 | B2 | 11/2015 | Clamp et al. | |
| 9,439,487 | B2 | 9/2016 | Barre et al. | |
| 9,615,639 | B2 | 4/2017 | Newman | |
| 9,655,423 | B1 | 5/2017 | Wang | |
| 9,723,903 | B2 | 8/2017 | Barre et al. | |
| 9,839,270 | B2 | 12/2017 | Howell et al. | |
| 10,092,075 | B2 | 10/2018 | Barre et al. | |
| 10,138,042 | B2 | 11/2018 | Fawdington et al. | |
| 10,194,724 | B2 | 2/2019 | Newman | |
| 10,368,621 | B2 | 8/2019 | Barre et al. | |
| 10,463,127 | B2 | 11/2019 | Kim | |
| 2008/0017525 | A1* | 1/2008 | Newman | A45C 11/008 264/2.6 |
| 2008/0078681 | A1* | 4/2008 | Newman | B65D 73/005 29/428 |
| 2015/0014187 | A1* | 1/2015 | Gilman | B65D 81/22 206/5.1 |
| 2019/0009977 | A1* | 1/2019 | Huang | B65B 25/008 |
| 2019/0046353 | A1* | 2/2019 | Greenwood | A61F 9/0008 |
| 2019/0293961 | A1 | 9/2019 | Schweizer et al. | |
| 2020/0229560 | A1 | 7/2020 | Almond et al. | |
| 2020/0229561 | A1 | 7/2020 | Almond et al. | |
| 2020/0229562 | A1 | 7/2020 | Almond et al. | |
| 2020/0229563 | A1 | 7/2020 | Almond et al. | |
| 2020/0231351 | A1 | 7/2020 | Almond et al. | |
| 2020/0231367 | A1 | 7/2020 | Almond et al. | |

* cited by examiner

CONTACT LENS PACKAGING

FIELD

The present disclosure generally relates to packaging for contact lenses, and more particularly, to contact lens packaging having means for presenting the anterior surface of a contact lens to a user.

BACKGROUND

This section provides background information related to the present disclosure which is not necessarily prior art.

Contact lenses are typically contained in disposable packages. For example, contact lenses may be contained in a plastic blister package that includes a receptacle portion for holding the contact lens and a sterile, hydrating solution such as a saline solution. The receptacle, containing the contact lens immersed in the solution, is hermetically sealed, for example, by sealing lid stock on the package over the receptacle. The package serves as a means to safely ship and store the lens. In use, a user removes the lid stock from the receptacle (e.g., at a flange or tab formed on the blister package) by peeling back the lid stock to expose the lens immersed in the hydrating solution. This package often requires users to search for the contact lens after opening.

SUMMARY

This section provides a general summary of the disclosure, and is not a comprehensive disclosure of its full scope or all of its features.

Example embodiments of the present disclosure generally relate to packaging for contact lenses. In one example embodiment, a contact lens package generally includes a first layer, a support coupled to the first layer, a lens, and a second layer. The support includes a scaffold and a porous member attached to the scaffold where the porous member includes a curved surface. The lens includes an anterior surface and a posterior surface, and the posterior surface of the lens is disposed on the curved surface of the porous member. The second layer is coupled to the first layer to seal the support and the lens between the first layer and the second layer.

In another example embodiment, a contact lens package generally includes a base and a cover coupled to the base, where the base and the cover define a receptacle for a contact lens. A support is disposed within the receptacle, and the support includes a dome-shaped porous member and a scaffold. The porous member is attached (e.g., secured, fixed, etc.) to the scaffold. The contact lens package also includes a contact lens having an anterior surface and a posterior surface. The posterior surface of the contact lens is disposed on the porous member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
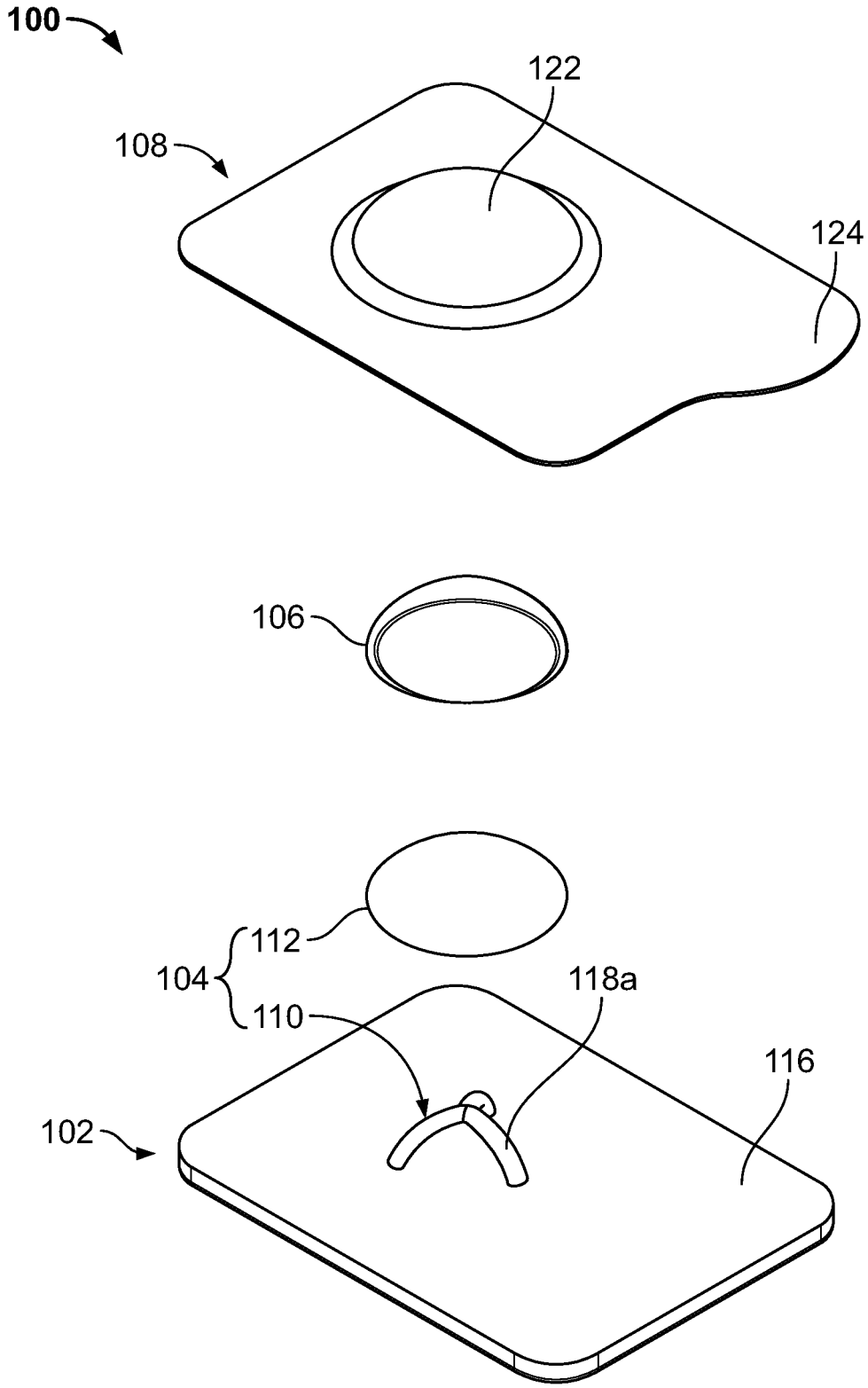
FIG. 1 is an exploded view of an example embodiment of a contact lens package.
Figure 2B:
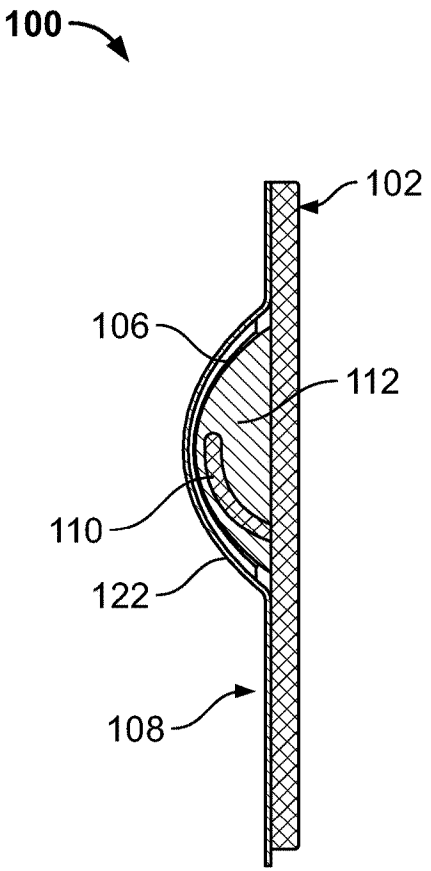
FIG. 2B is a side view of the contact lens package of FIG. 1 taken along line 2B-2B in order to illustrate the contact lens and supporting structure within the contact lens package.
Figure 2A:
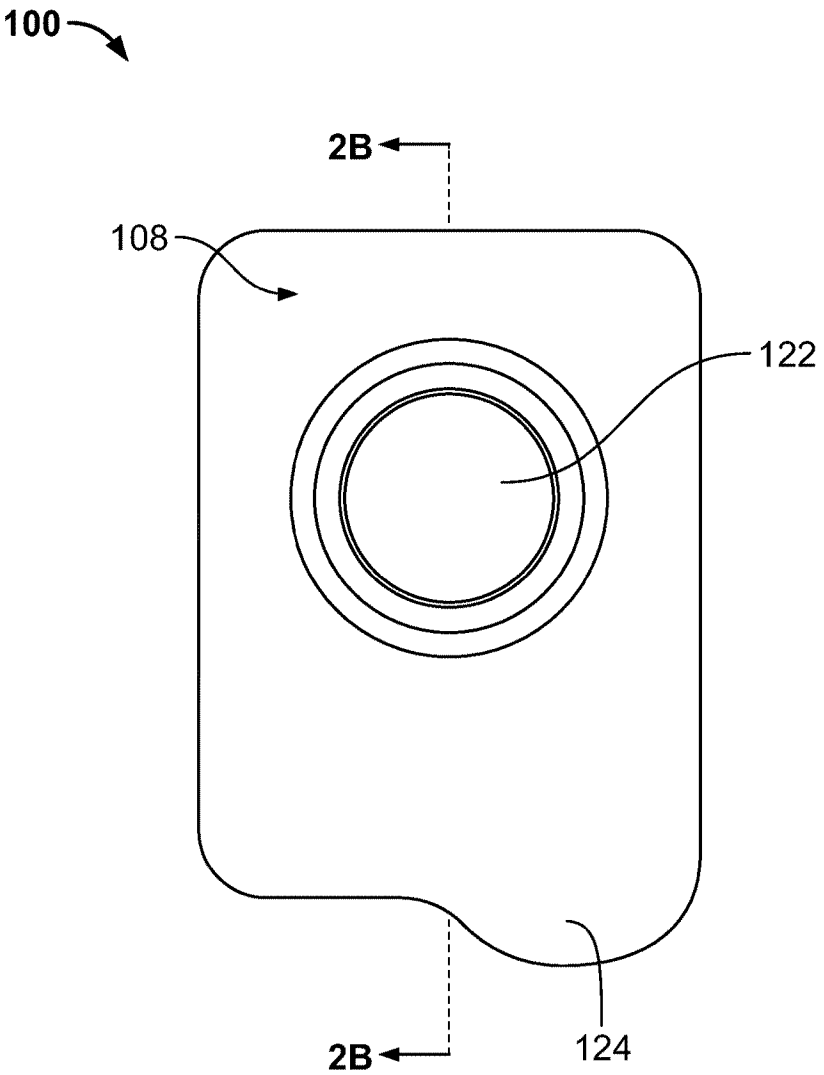
FIG. 2A is a top view of the contact lens package of FIG. 1.

Example embodiments of the present disclosure generally relate to contact lens packages that include means for precisely positioning a contact lens within the package, for example, where an anterior surface (e.g., a convex surface) of the contact lens is presented to a user. Contact lens packages commonly include a receptacle for holding a contact lens immersed in a sterile packaging solution, where the contact lens is able to move about within the receptacle (e.g., where a user has to search for the lens within the receptacle, etc.). Uniquely, the contact lens packages of the present disclosure include a dome-shaped (e.g., hemispherical, etc.) porous polymer feature which supports the contact lens within the package in a particular position which enables the contact lens to be easily located within the package. This structure prevents contact lens inversion and folding during the shelf life of the article. Due to the porosity of the porous polymer feature and its ability to absorb liquid (e.g., saline solution), the porous polymer feature, in addition to positioning the lens, simultaneously hydrates the lens and reduces fill volume within the packaging (e.g., the package requires less saline solution). This enables, in some embodiments, a dry lens to be packaged with the porous polymer feature. In particular, the porous polymer feature (e.g., a hydrogel, etc.) is attached to a support structure that is coupled to an interior surface of the package (e.g., to a lid stock, to a base, etc.), where the curved surface of the porous polymer feature supports the lens, such that an anterior surface of the lens is presented to the user upon opening of the package. Because the anterior side of the lens is up when the package is opened, a more hygienic transfer of the lens to an eye of the user is possible (e.g., fewer steps are needed to properly orient the lens, a user does not need to touch the posterior surface of the lens to remove the lens from the package, etc.).

Example embodiments will now be described more fully with reference to the accompanying drawings. The description and specific examples included herein are intended for purposes of illustration only and are not intended to limit the scope of the present disclosure.

FIGS. 1-7 illustrate an example embodiment of a package 100 for contact lenses including one or more aspects of the present disclosure. In the illustrated embodiment, the package 100 generally includes a base 102 (broadly, a first layer), a support 104 for positioning a contact lens 106 within the package 100, and a lid stock 108 (broadly, a second layer) that is coupled to the base 102 (e.g., to seal the contact lens 106 within the package 100). The support 104 includes a scaffold 110 and a porous member 112 (e.g., a hemispherical or dome-shaped hydrogel, etc.) that is coupled to the scaffold 110. In the illustrated embodiment, the scaffold 110 is coupled to the base 102 and the lens 106 is generally positioned on the porous member 112 within the package 100.

As shown in FIG. 1, the base 102 is configured as a rigid plastic tray and is generally flat, for example, apart from the scaffold 110 included thereon. In the illustrated embodiment, the base 102 is generally rectangular, however, it should be appreciated that the base 102 may include other shapes such as curved, elliptical, etc. without departing from the scope of the present disclosure. The rigidity of the base 102 prevents damage to the contact lens 106 during transport, shipping, storage, etc. of the package 100. Additionally, the base 102 provides a sturdy grip for a user when peeling (e.g., removing) the lid stock 108 away from the base 102 to allow access to the lens 106 within the package 100. In some embodiments, the base 102 includes a grip portion 114 (e.g., a textured portion, an opening defined by the base 102, a tab, etc., see FIGS. 3A, 3B) to facilitate additional grip for the user when removing the lens 106 from the package 100.

The base 102 is formed of a molded plastic (e.g., thermoformed, injection molded, 3D printed, etc.). For example, the base 102 may be formed of any suitable material such as injection molded or thermoformed plastics for medical packaging including PET (polyethylene terephthalate), PP (polypropylene), HDPE (high density polyethylene), PS (polystyrene), PA (polyamide), etc.; bio-based plastics such as bio-PET, bio-PE/PP and bio-PEF (polyethylene furanoate), etc.; other materials including biodegradable PLA (polylactic acid), PHA (polyhydroxyalkanoate), PBS (polybutylene succinate), cellulose acetate, starch and related compounds; and/or plastic laminated materials including combinations of two or more of the example polymers listed above with requisite binders (e.g., hot melt PE or EVOH), recyclable paper/bio-polymer composites such as paper/PLA or paper/PE laminates, light-weighted options such as microfibrillated cellulose coatings on paper, etc. In some embodiments, the base 102 is stereolithographic 3D printed from PA 2200, for example.

In the illustrated embodiment, the scaffold 110 is integrally formed with the base 102 (e.g., the base 102 and the scaffold 110 are formed as one piece) and the scaffold 110 is formed of the same material as the base 102. In other embodiments, the scaffold 110 may be separate from the base 102 and coupled thereto. Additionally, in some embodiments, the scaffold 110 may be formed of a different material than the base 102, without departing from the scope of the present disclosure. The scaffold 110 is configured to anchor (e.g., secure, etc.) the porous member 112 to the base 102. The scaffold 110 precisely positions the porous member 112 within the package 100, for example, in a manner that prevents the porous member 112 from freely moving within the package 100. This enables the lens 106 to be easily located within the package 100, as the lens 106 is disposed on the porous member 112 which is positioned in a fixed location within the package 100.

Figure 3B:
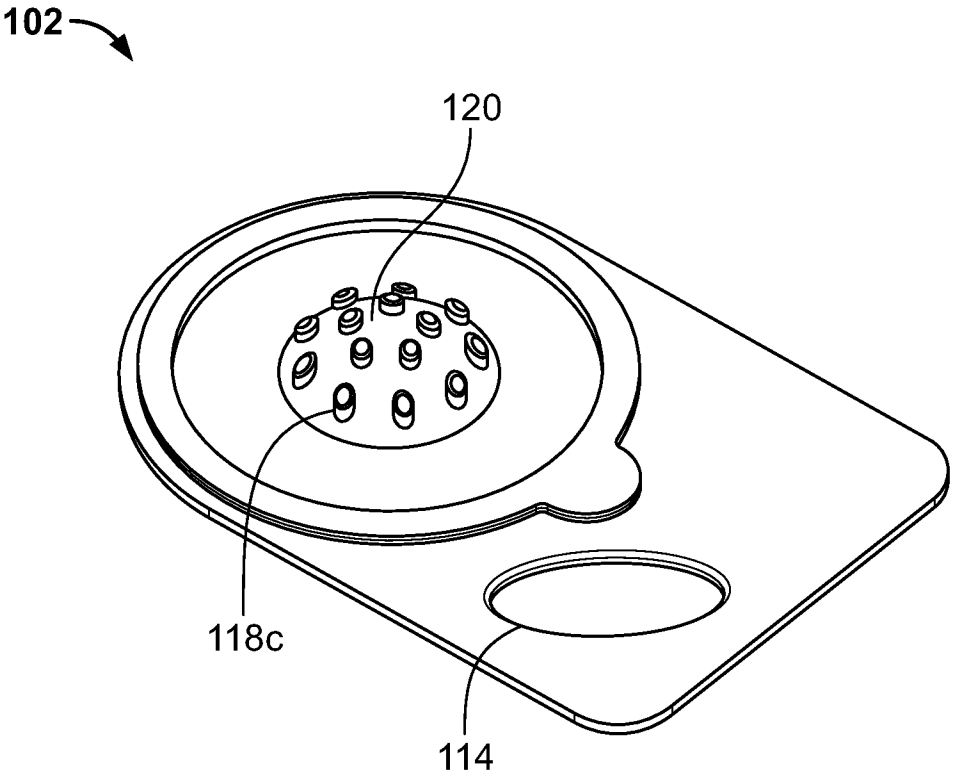
FIG. 3B is a perspective view of the contact lens package of FIG. 1 including another alternate configuration of the scaffold support structure.
Figure 3A:
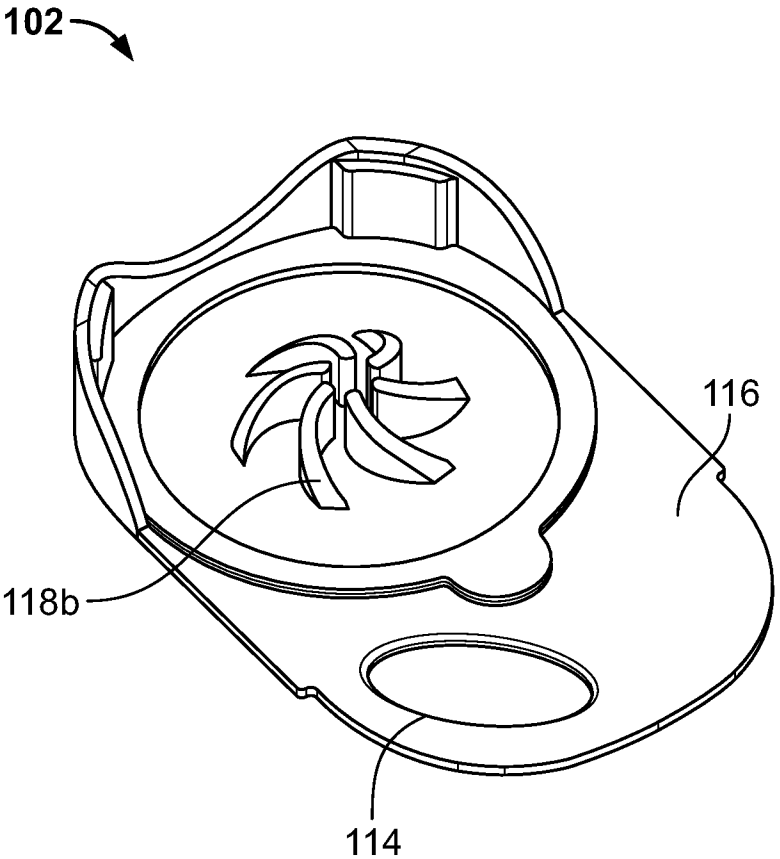
FIG. 3A is a perspective view of the contact lens package of FIG. 1 including an alternate configuration of a scaffold support structure.

To anchor the porous member 112 to the base 102, the scaffold 110 includes structures which project upwards from an upper surface 116 of the base 102 and provide a means of attachment for the porous member 112. In the illustrated embodiment of FIGS. 1, 2, the scaffold 110 includes three projections 118*a* that extend upwardly from the upper surface 116 of the base and are curved towards a central point (e.g., forming a dome-shape). It should be appreciated that in other embodiments, the scaffold 110 includes other configurations for anchoring the porous member 112 to the base 102 without departing from the scope of the present disclosure. For example and without limitation, FIGS. 3A-3B illustrate alternate configurations of the scaffold 110. In FIG. 3A, the scaffold 110 includes projections 118*b* that increase in height from an outer circumference of the scaffold 110 towards a central point in a swirled configuration. This design, including projections 118*b*, may be injection molded, for example. And, FIG. 3B depicts a scaffold 110 that includes multiple projections 118*c* which are positioned on a curved or domed surface 120 (see also FIGS. 4-6). This design, including projections 118*c*, may be thermoformed, for example.

The porous member 112 is coupled to the scaffold 110 (e.g., is formed around the scaffold 110, etc.). In the illustrated embodiment, the porous member 112 is fixed to the scaffold 110 in a secure manner, such that the porous member 112 is positioned in a precise location (e.g., as defined by the positioning of the scaffold 110) and the porous member 112 is not easily detached from the scaffold 110. Alternatively, in some embodiments, the porous member 112 is removable from the scaffold 110, for example, as a coating on the lens 106. In particular, in these embodiments, the porous member 112 is used to tune the surface of the lens 106 (e.g., to create a hydrophilic surface, to deposit beneficial ingredients onto the lens 106, to incorporate antimicrobial properties, etc.). The porous member 112 includes a curved surface which supports the concave (posterior) surface of the lens 106, such that the convex (anterior) surface of the lens 106 is presented to the user upon opening the package 100. In particular, in the illustrated embodiment, the porous member 112 is a dome-shaped (e.g., hemispherical) dollop or bump where the curvature of the porous member 112 generally corresponds to the curvature of the lens 106. It should be appreciated that the porous member 112 may be formed in other shapes besides hemispherical including, but not limited to, cylindrical or triangular in shape. The lens 106 is positioned on the porous member 112 with the anterior side up such that the user may remove the lens 106 from the package 100 and insert the lens 106 without touching the portion of the lens 106 which contacts the user's eye (e.g., the posterior surface of the lens 106). The surface of the porous member 112, in some embodiments, includes a textured surface comprising multiple dimples or bumps to facilitate easier removal of the lens 106 from the porous member 112 (e.g., by reducing contact between the two surfaces, to help reduce the lens 106 "sticking" to the porous member 112, etc.). By precisely positioning the lens 106 such that the anterior surface is presented to the user, the porous member 112 provides an efficient and more hygienic presentation of the contact lens for the user (e.g., such that the user does not have to search for the lens, determine the correct orientation of the lens, touch the posterior surface of the lens, etc.).

Moreover, the porous member 112 is able to provide a means for hydration for the lens 106, for example, due to its porosity. In particular, the porous member 112 is configured to absorb a buffered saline solution such that the porous member 112 is able to maintain the hydration of the lens 106 within the package 100. In some embodiments, the porous member 112 is capable of absorbing, for example, between 5% and 95% as measured gravimetrically of a buffered saline solution. The porous member 112 may be formed of a hydrogel that is injection molded, cast molded, and/or sintered into the hemispherical or dome shape. Further, the porous member 112 may include a hydrogel capable of medical applications and is antimicrobial, such as an agar hydrogel. Alternatively, in some embodiments, the porous member 112 includes a thermoplastic or thermoset polymer that is capable of capillary and/or wicking phenomena, rather than a hydrogel. Based on the natural capillary action of these materials, a low-pressure interface between the porous member 112 and the contact lens 106 may be created. Examples of such materials include thermoplastic or thermoset polymers that are manufactured by POREX®. In some embodiments, the porous member 112 is formed of a material that has a high surface energy (e.g., >29 mN/m). It should be appreciated that the porous member 112 may be formed from other suitable materials to support the lens 106 that are capable of absorbing and retaining a buffered saline solution. In connection therewith, because the porous member 112 absorbs and retains the buffered saline solution, the fill volume within the package 100 is reduced. As the support 104 for the lens 106 takes up volume within the package 100 while simultaneously hydrating the lens 106, less additional buffered saline solution is necessary within the package 100.

In combination with hydrating the lens 106 within the package 100, the buffered saline solution contains ingredients or components which may be imparted onto the lens 106 and/or diffused into the lens 106, for example, via the porous member 112. In particular, in some embodiments, the buffered saline solution contains antimicrobial agents, wetting agents, antihistamine, nutraceuticals, osmoprotectants, etc. that can be diffused into and/or imparted onto the lens 106. Further, in some embodiments, the buffered saline solution contains additives such as erythritol, glycerol, mannitol, sorbitol, and/or propylene glycol, etc. The buffered saline solution, in some embodiments, contains one or more block copolymers including a combination of polyethylene oxide and polypropylene oxide blocks.

To form the porous member 112, a mold (not shown) may be used in conjunction with the base 102. In particular, in embodiments where the porous member 112 is a hydrogel, for example, a mold is filled with a hydrogel prepolymer and encapsulated with the base 102, with the portion of the base 102 that includes the scaffold 110 being positioned within the mold. When the hydrogel polymerizes, the porous member 112 is fixed to the scaffold 110 to form the support 104. In some embodiments, depending on the configuration of the scaffold 110 (e.g., depending on the configuration of the projections 118, etc.), the porous member 112 is injection molded and subsequently fitted to the base 102 at the scaffold 110. In these embodiments, the porous member 112 is coupled to the scaffold 110 through a rivet-like interference fit. It should be appreciated that the porous member 112 may be formed and coupled to the scaffold 110 using other processes without departing from the scope of the present disclosure.

Figure 4:
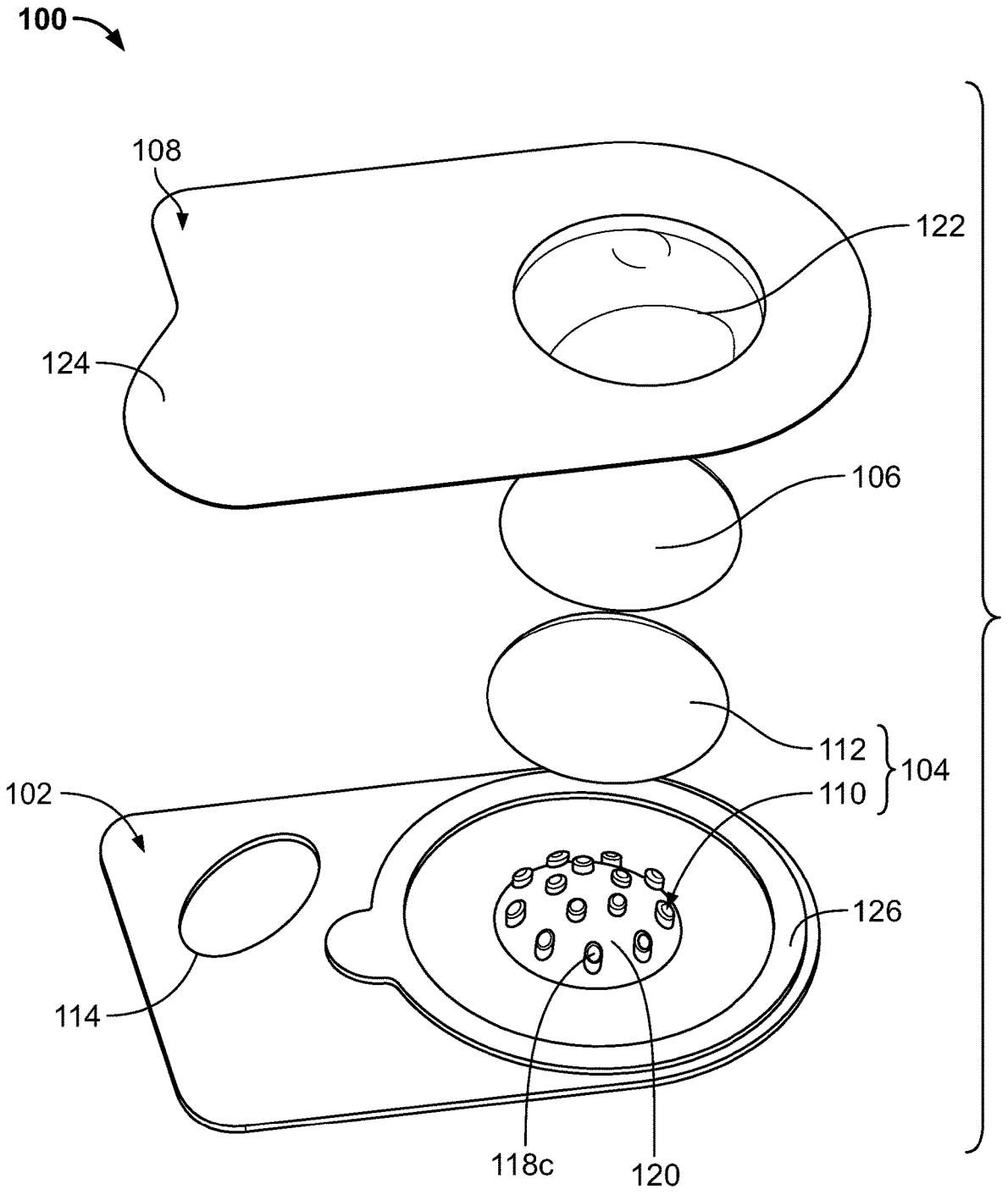
FIG. 4 is an exploded view of the contact lens package of FIG. 1 including the scaffold support structure of FIG. 3B.
Figure 5:
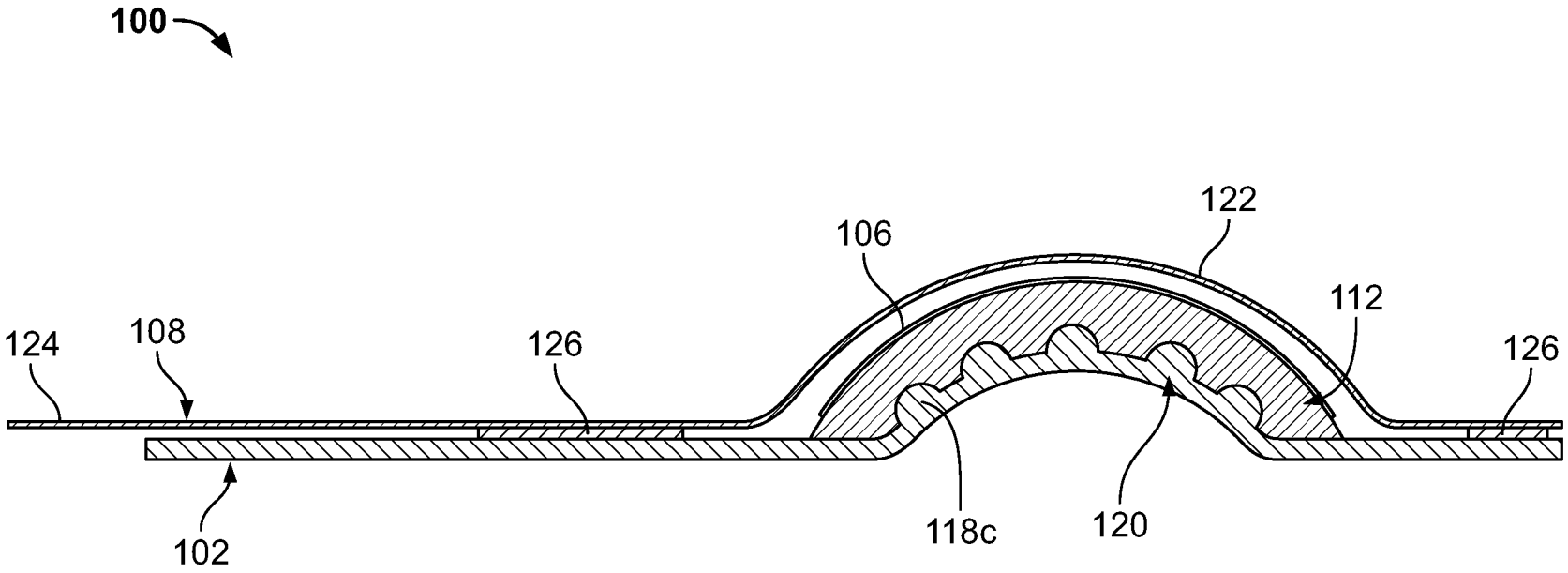
FIG. 5 is a side cut-away view of the sealed contact lens package of FIG. 4.

As described above, the package 100 also includes the lid stock 108 (broadly, a cover, a second layer, etc.). The lid stock 108 is coupled to the base 102 to hermetically seal the support 104, the lens 106, and a buffered saline solution within the package 100. In some embodiments, the lid stock 108 is coupled to a raised surface 126 of the base 102, for example, where the raised surface 126 surrounds the scaffold 110, as shown in FIG. 4. In the illustrated embodiment, the lid stock 108 includes a curved, dome portion 122 (e.g., an embossed dome) that is aligned with the support 104. When the lid stock 108 is coupled to the base 102, the dome portion 122 of the lid stock 108, in combination with the base 102, accommodates and creates a receptacle for the support 104 and the lens 106 within the package 100. In some embodiments, the lid stock 108 includes a tab 124 which extends at least partially beyond the base 102 to facilitate opening of the package 100. In particular, a user may remove the lid stock 108 by peeling the lid stock 108 away from the base 102 beginning at the tab 124.

The lid stock 108 comprises a foil material, such as a multilayer laminated foil material. Examples of multilayer laminated foil include polypropylene backed aluminum foil with a thickness of 30 to 300 microns, with a preferred thickness between 20-150 microns. In some embodiments, the aluminum foil is cold rolled from billets and finished by the addition of a seal layer. Seal layer materials include polypropylene and low & high-density polyethylene and blends thereof. The multilayer laminated foil also includes a topcoat (opposite to the seal layer) that is used for marking, printing, etc. In some embodiments, the multilayer laminated foil for the lid stock 108 includes a foil made with cold rolled soft aluminum, a polypropylene/LDPE seal layer and polyvinyl butyrate/polyurethane top print layer. For those embodiments, the weight fraction of aluminum with respect to the total laminate is greater than 85%, with the preferred fraction of 90%. The recyclability of such a laminate is enhanced with a greater weight fraction of aluminum as the separation of the seal material from the aluminum can be cumbersome. In some embodiments, the material for the lid stock 108 may be hydrophilic in nature due to the combination of surface texture and seal layer composition.

To fabricate the lid stock 108, the lid stock 108 is converted from a roll of laminate film (e.g., the foil material described above) into a single piece lid, for example, through a web conversion process of die cutting and forming. In particular, the lid stock 108 is initially die cut into the desired shape. Then, the dome portion 122 of the lid stock 108 is formed through a cold forming process. After the lid stock 108 is fabricated, the lid stock 108 is attached to the base 102 through a heating process. It should be appreciated that the lid stock 108 may be formed through other processes and/or in a different order without departing from the scope of the present disclosure.

Figure 6:
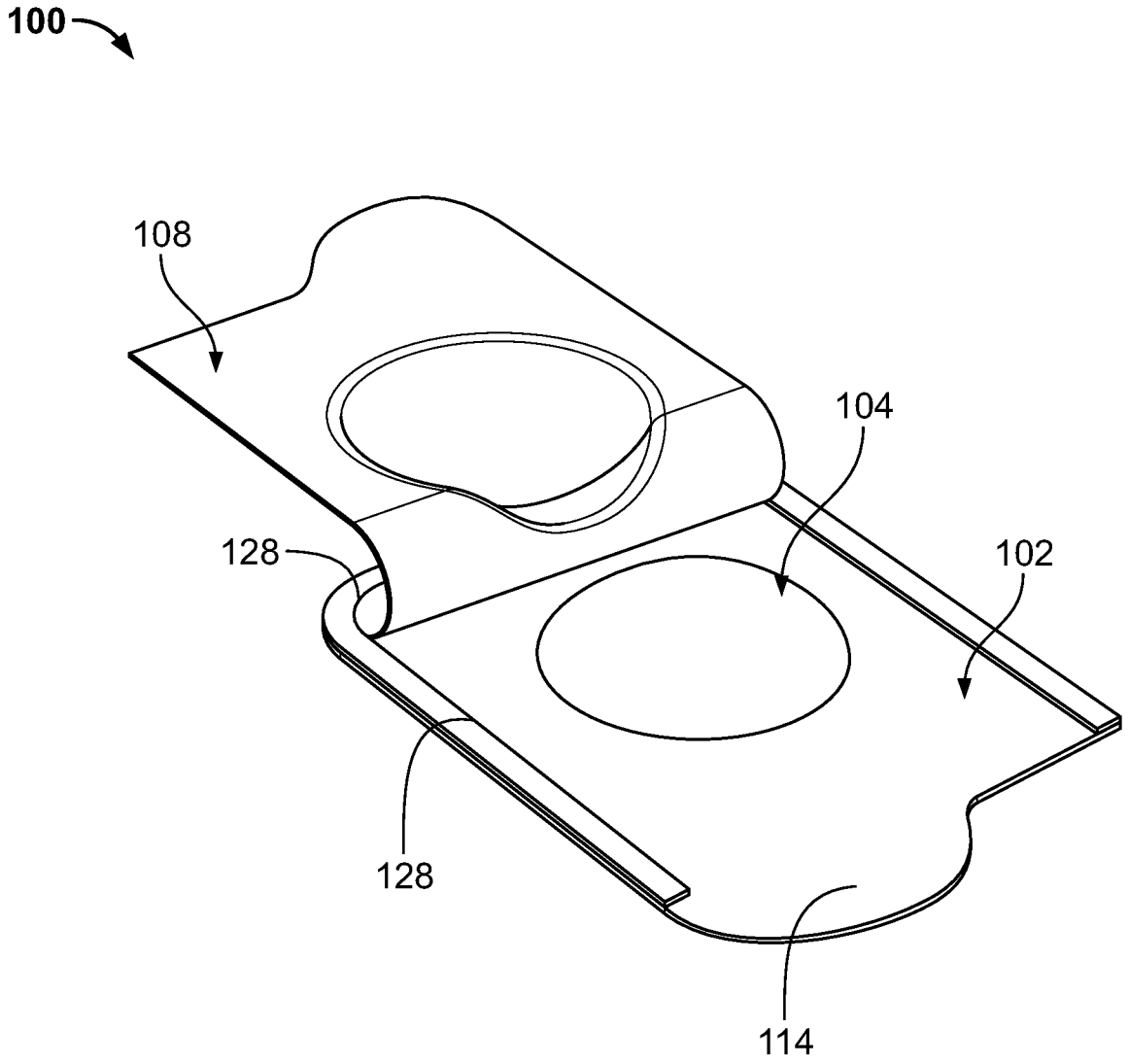
FIG. 6 is a perspective view of the contact lens package of FIG. 1 with the lid stock partially peeled away from a base of the contact lens package (e.g., along a perforation line)

In some embodiment, the lid stock 108 includes perforations 128, as shown in FIG. 6. Perforations 128 may be formed in the lid stock 108, for example, through a laser scoring process. In the illustrated embodiment, the perforations 128 are disposed in a line adjacent the outer edge of the lid stock 108 and provide a guide for the preferential tearing of the lid stock 108 during opening of the package 100. Further, the perforations 128 may provide a means of tamper proofing the package 100 (e.g., as a visual indicator of whether the package 100 has been opened, etc.). It should be appreciated that the perforations 128 may be disposed in other configurations on the lid stock 108 without departing from the scope of the present disclosure.

Figure 7A:
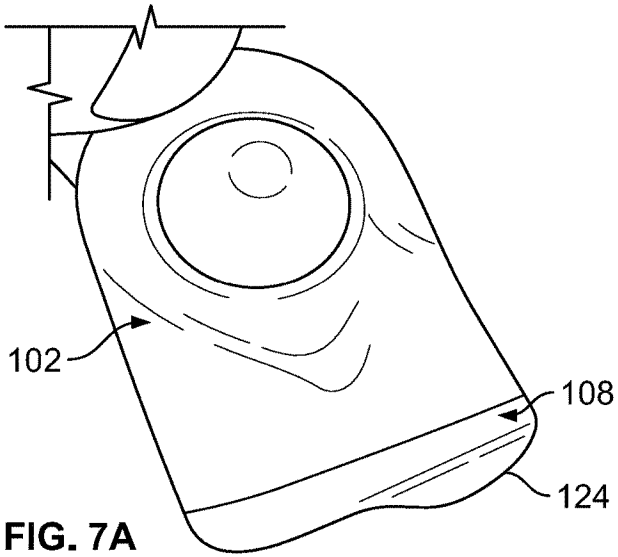
FIGS. 7A-7D illustrate an example process of opening the contact lens package of FIG. 1.
Figure 7B:
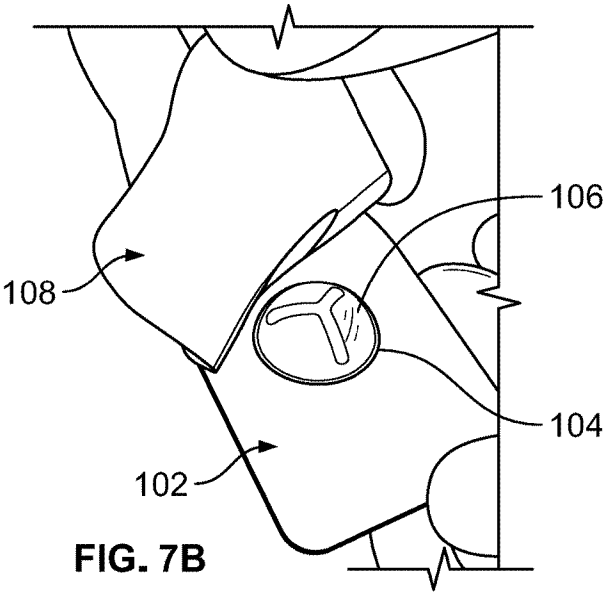
Figure 7C:
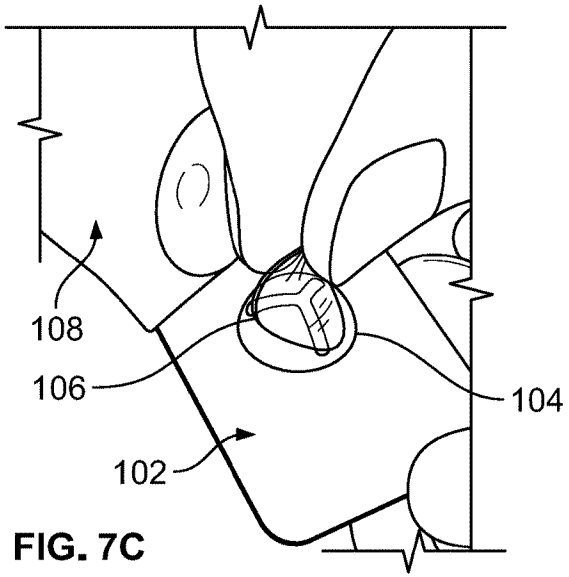
Figure 7D:
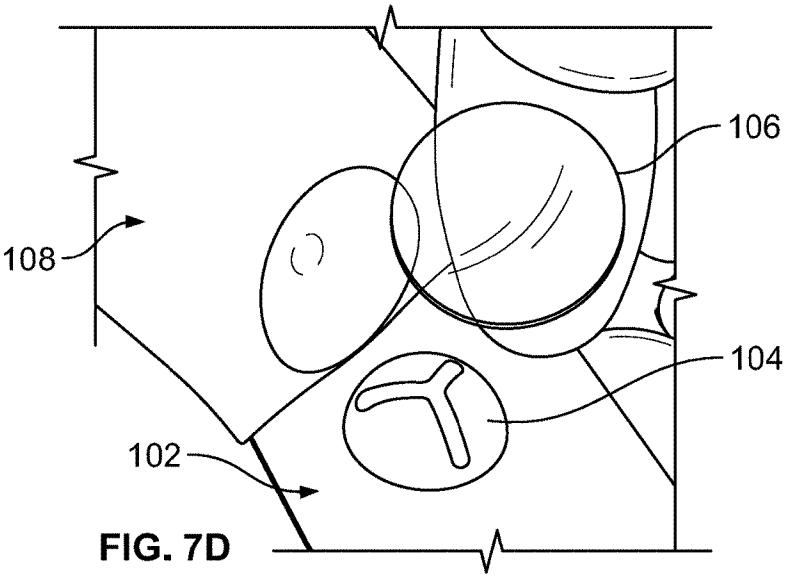

FIGS. 7A-7D illustrate an example process for opening the package 100 and removing the lens 106 from the package 100. To open the package 100, a user initially grips the base 102 and the lid stock 108 at the tab 124, for example. Applying force, the user peels the lid stock 108 away from the base 102, as shown in FIG. 7B. When the lid stock 108 is removed (e.g., peeled away from the base 102), the lens 106 remains disposed on the support 104. For example, because of the surface energy of the porous member 112 of the support 104, the lens 106 sticks to the support 104 as the lid stock 108 is peeled away from the base 102 (e.g., rather than sticking to the lid stock 108, etc.). In this way, upon opening the package 100, the lens 106 is presented on the support 104 with the anterior surface of the lens 106 positioned upwards, such that the user does not need to touch the posterior surface of the lens 106 which contacts the eye of the user. The user may then remove the lens 106 from the support 104 using a single hand, for example, by pinching the anterior surface of the lens 106, as shown in FIG. 10C. The anterior surface of the lens 106 is positioned on a finger of the user in the correct orientation, that is, with the posterior surface of the lens 106 facing away from the finger, as shown in FIG. 7D. In this orientation, the user does not need to re-orient the lens 106 prior to insertion of the lens 106 into the eye.

Figure 8:
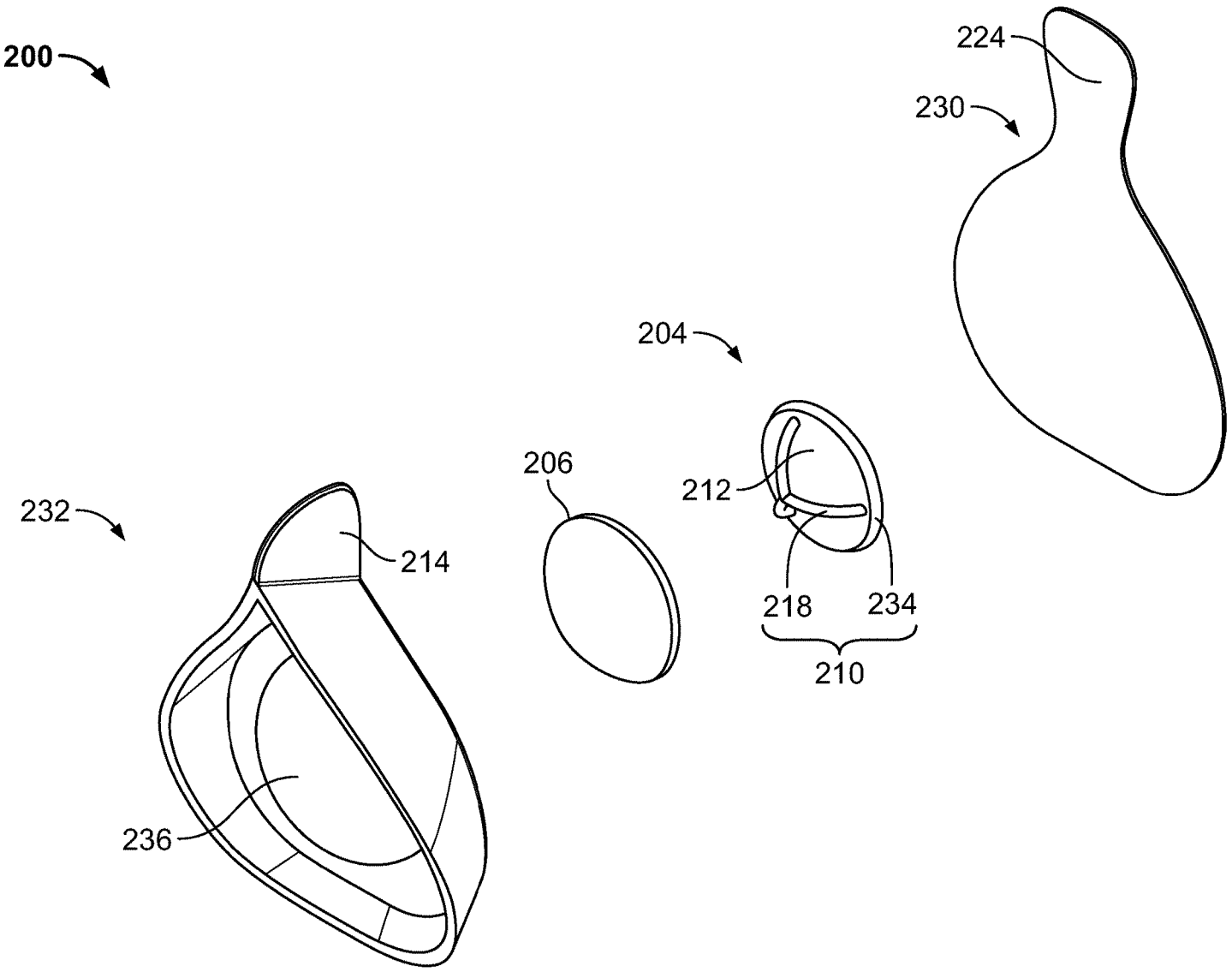
FIG. 8 is an exploded view of another example embodiment of a contact lens package.
Figure 9B:
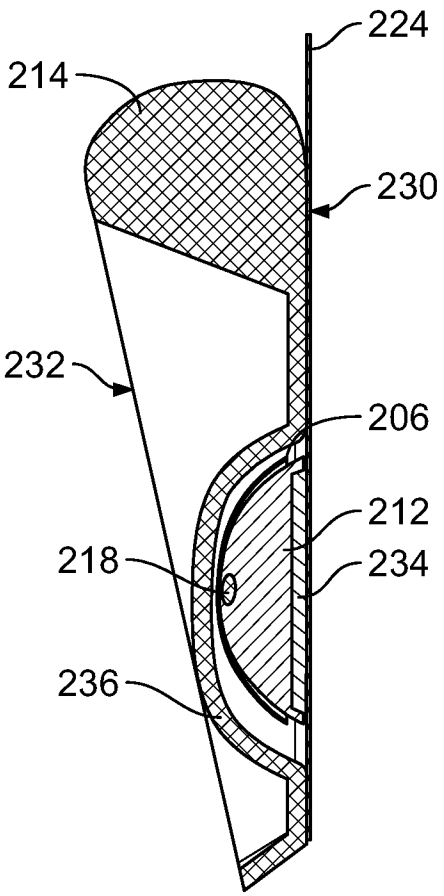
FIG. 9B is a side view of the contact lens package of FIG. 9A taken along line 9B-9B in order to illustrate the contact lens and supporting structure within the contact lens package.

FIGS. 8-10 illustrate another example embodiment of a package 200 for contact lenses including one or more aspects of the present disclosure. In the illustrated embodiment, the package 200 generally includes a lid stock 230 (broadly, a first layer, a cover, etc.), a support 204 for positioning a contact lens 206 within the package 200, and a base 232 (broadly, a second layer). The lid stock 230 is coupled to the base 232 to retain the contact lens 206 within the package 200 (e.g., during transport, storage, etc.). Similar to support 104 described above, the support 204 includes a scaffold 210 and a porous member 212 (e.g., a hemispherical or dome-shaped hydrogel, etc.). In this embodiment, the support 204 is coupled to the lid stock 230 (e.g., rather than a rigid base).

Figure 9A:
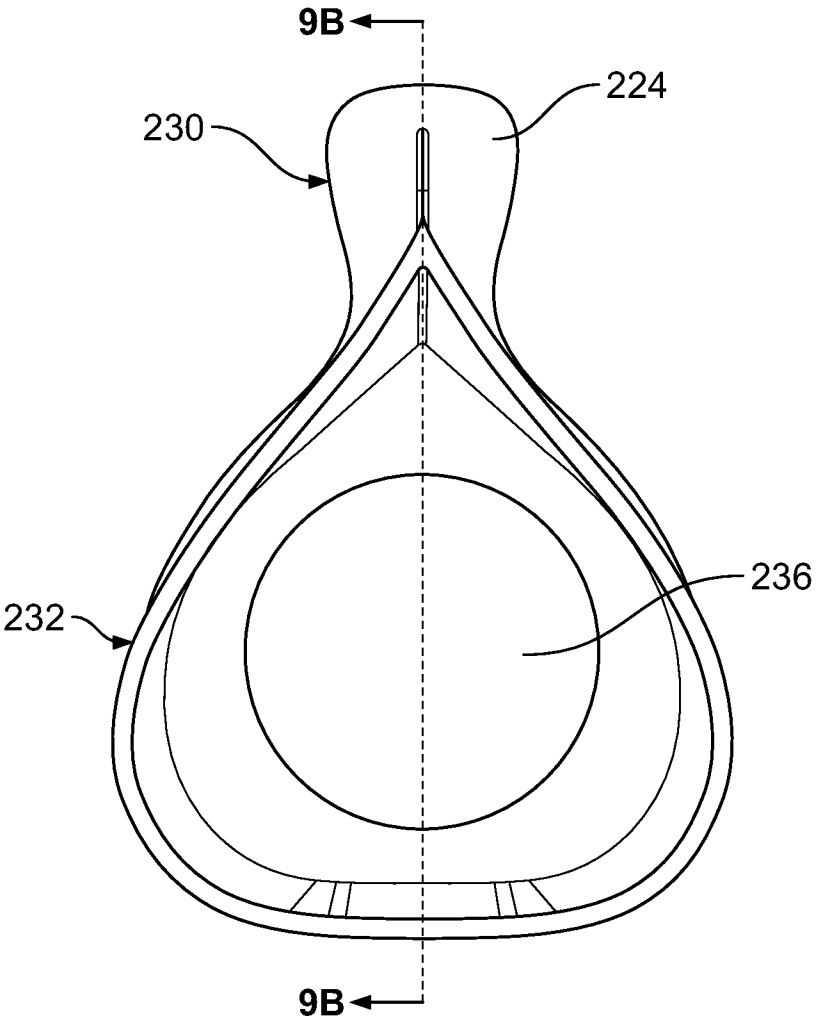
FIG. 9A is a bottom view of the contact lens package of FIG. 8.

The lid stock 230 is generally flat (e.g., does not include a dome portion, etc.) and is formed of a foil material, such as those described above in connection with lid stock 108. In the illustrated embodiment, the lid stock 230 is coupled to the base 232 to hermetically seal the support 204 and the contact lens 206 within the package 200. The lid stock 230 includes a tab 224 to facilitate removal of the lid stock 230 from the base 232 and provide access to the contact lens 206. As shown in FIG. 9A, the tab 224 extends at least partially beyond the base 232 to enable a user to easily grip the lid stock 230 at the tab 224.

In the illustrated embodiment, the support 204 for the contact lens 206 is coupled to the lid stock 230. In particular, the scaffold 210 of the support 204 is directly coupled to the interior surface of the lid stock 230 and the porous member 212 is attached (e.g., anchored, secured, fixed, etc.) to the scaffold 210. As shown in FIG. 8, the scaffold 210 includes a base plate 234 and three projections 218 extending from the base plate 234. The base plate 234 is directly coupled to the lid stock 230 through a plastic joining process. For example, the scaffold 210 is attached to the lid stock 230 through heat staking, ultrasonic welding, etc. The projections 218, similar to projections 118*a*, are curved towards a central point of the scaffold 210 and form a dome shape. It should be appreciated that the scaffold 210 may include other configurations of projections without departing from the scope of the present disclosure, similar to those disclosed above. The porous member 212 is coupled to the scaffold 210 (e.g., formed around the projections 218 of the scaffold 210) and includes a curved surface which corresponds to the curvature of the contact lens 206. In particular, the posterior (concave) surface of the contact lens 206 is supported on the porous member 212, such that the anterior (convex) surface of the lens 206 is presented to the user. Similar to porous member 112, the porous member 212 is formed of a material that is capable of absorbing a buffered saline solution, such as those described above, including a hydrogel (e.g., an antimicrobial hydrogel, an injection molded, cast molded, or sintered hydrogel, etc.), a thermoplastic or thermoset polymer capable of capillary and/or wicking phenomena, etc.

The base 232 is generally shaped as a blister and includes a dome-shaped basin 236 as a receptacle for the contact lens 206 and the support 204. In the illustrated embodiment, the base 232 is formed of a rigid plastic material, such as those described above in connection with base 102. In the illustrated embodiment, the base 232 includes a gripping portion 214 that is configured as a tab. In other embodiments, the gripping portion 214 may include a textured portion, an opening, or other configuration to enable a user to easily grip the base 232. The lid stock 230 is coupled to the upper surface of the base 232 through a heat-sealing process.

Figure 10A:
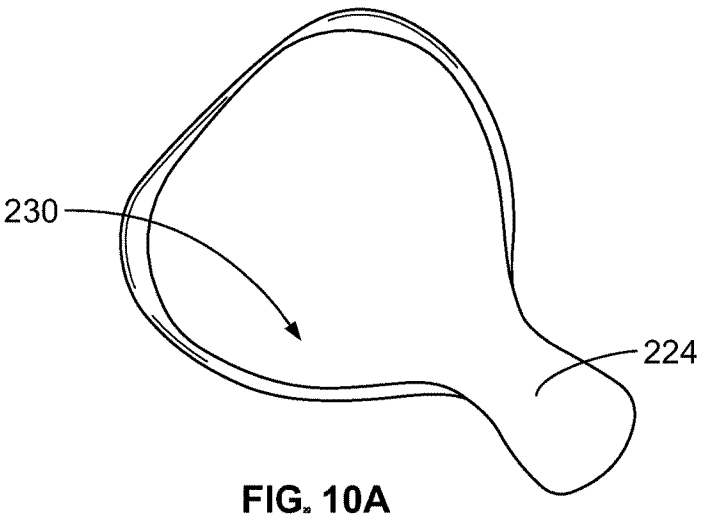
FIGS. 10A-10D illustrate an example process of opening the contact lens package of FIG. 8.
Figure 10B:
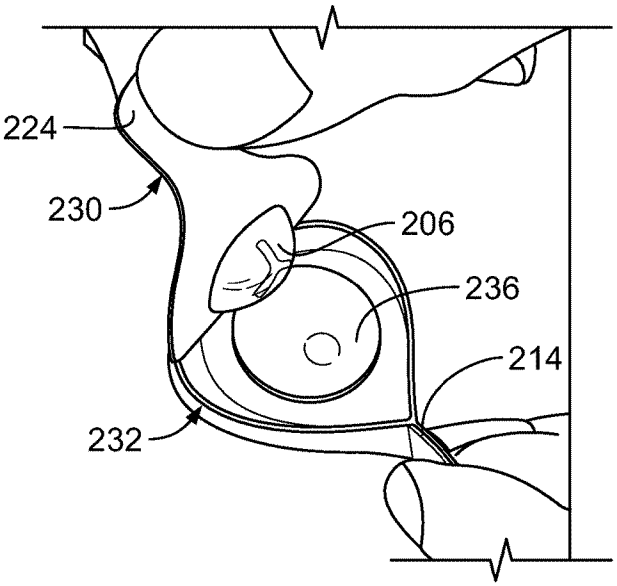
Figure 10C:
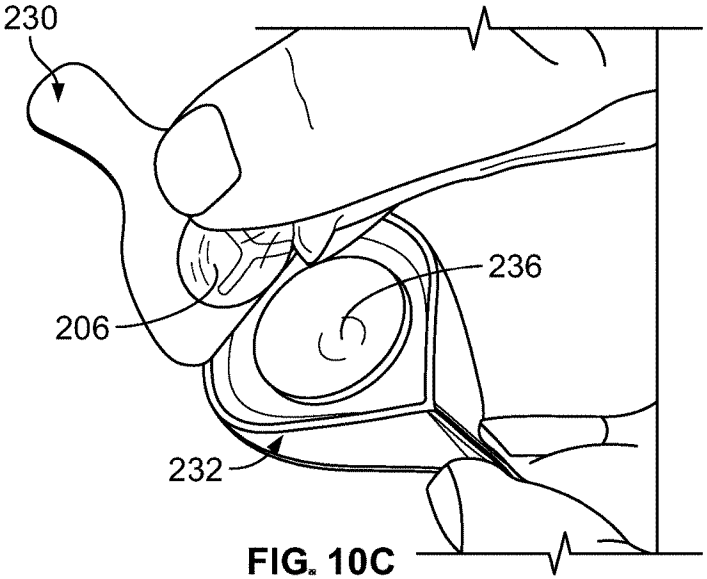
Figure 10D:
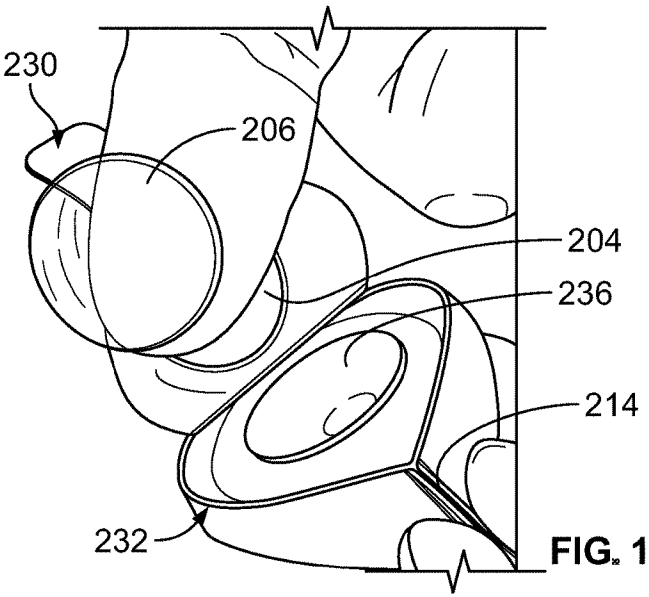

FIGS. 10A-10D illustrate a process for opening the package 200. To open the package 200, a user initially grips the base 232, for example, at the gripping portion 214 and also grips the lid stock 230, for example, at the tab 224. Applying force, the user peels the lid stock 230 away from the base 232, as shown in FIG. 10B. When the lid stock 230 is removed (e.g., peeled away from the base 232), the lens 206 remains disposed on the support 204, rather than remaining in the basin 236 or falling out of the package 200. For example, because of the surface energy of the porous member 212 of the support 204, the lens 206 sticks to the support 204 as the lid stock 230 is peeled away from the base 232. In this way, upon opening the package 200, the lens 206 is presented on the support 204 with the anterior surface of the lens 206 positioned upwards (e.g., such that the user does not need to touch the posterior surface of the lens 206 which contacts the eye of the user). The user may then remove the lens 206 from the support 204 using a single hand, for example, by pinching the anterior surface of the lens 206, as shown in FIG. 10C. The anterior surface of the lens 206 is positioned on a finger of the user in the correct orientation (e.g., with the posterior surface of the lens 206 facing away from the finger, etc.), as shown in FIG. 10D, such that the user does not need to re-orient the lens 206 prior to insertion of the lens 206 into the eye.

Contact lens packages of the present disclosure include a unique support structure (e.g., a dome-shaped porous member anchored to a scaffold) which precisely positions a contact lens within the package, while simultaneously hydrating the lens and reducing fill volume within the packaging. By securing the support structure to an interior surface of the package, the contact lens is able to be easily located within the package in a proper orientation with an anterior surface (e.g., a convex surface) of the contact lens presented to a user. Because the anterior side of the lens is up when the package is opened, a more hygienic transfer of the lens to an eye of the user is possible (e.g., fewer steps are needed to properly orient the lens, a user does not need to touch the posterior surface of the lens to remove the lens from the package, etc.).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" as well as the phrase "at least one of" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper", "lower" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the present disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the present disclosure, and all such modifications are intended to be included within the scope of the present disclosure.

What is claimed is:

1. A contact lens package comprising:

a first layer;

a support coupled to the first layer, the support including a dome-shaped scaffold and a dome-shaped hydrogel is formed around the domed-shaped scaffold;

a lens including an anterior surface and a posterior surface, wherein the posterior surface of the lens is disposed on the dome-shaped hydrogel; and a second layer coupled to the first layer to seal the support and the lens between the first layer and the second layer.

2. The contact lens package of claim 1, wherein the first layer is a rigid plastic tray and wherein the second layer is a foil lid stock.

3. The contact lens package of claim 1, wherein the scaffold is integrally formed with the first layer.

4. The contact lens package of claim 1, wherein the first layer is a foil lid stock and the second layer is a rigid plastic blister.

5. The contact lens package of claim 1, wherein the dome-shaped hydrogel is a sintered material.

6. The contact lens package of claim 1, wherein the domed-shaped hydrogel exhibits antimicrobial properties.

7. The contact lens package of claim 1, wherein the hydrogel is capable of absorbing at least 5% of a buffered saline solution.

8. The contact lens package of claim 7, wherein the buffered saline solution contains antimicrobial agents that can be diffused into the lens.

9. The contact lens package of claim 7, wherein the buffered saline solution contains wetting agents that can be imparted onto the lens.

10. The contact lens package of claim 7, wherein the buffered saline solution contains antihistamine that can be diffused into the lens.

11. The contact lens package of claim 7, wherein the buffered saline solution contains nutraceuticals that can be diffused into the lens.

12. The contact lens package of claim 7, wherein the buffered saline solution contains osmoprotectants that can be diffused into the lens.

13. The contact lens package of claim 7, wherein the buffered saline solution contains additives selected from the group consisting of erythritol, glycerol, mannitol, sorbitol, and propylene glycol.

14. The contact lens package of claim 7, wherein the buffered saline solution contains one or more block copolymers comprising a combination of polyethylene oxide and polypropylene oxide blocks.

15. The contact lens package of claim 1, wherein at least one of the first layer and the second layer include perforations.

16. A contact lens package comprising:

a base;

a cover coupled to the base, the base and the cover defining a receptacle for a contact lens;

a support disposed within the receptacle, the support including a dome-shaped hydrogel and a dome-shaped scaffold, wherein the dome-shaped hydrogel is formed around the dome-shaped scaffold; and a contact lens including an anterior surface and a posterior surface, wherein the posterior surface of the contact lens is disposed on the domed-shaped hydrogel.

17. The contact lens package of claim 16, wherein the support is coupled to the base.

18. The contact lens package of claim 16, wherein the support is coupled to the cover.

19. The contact lens package of claim 16, wherein the hydrogel is capable of absorbing a buffered saline solution.

20. The contact lens package of claim 16, wherein the hydrogel exhibits antimicrobial properties.

21. The contact lens package of claim 16, wherein the cover includes perforations.

22. The contact lens package of claim 16, wherein the cover is hermetically sealed to the base.

* * * * *